US011486248B2

(12) United States Patent
Kulkarni et al.

(10) Patent No.: US 11,486,248 B2
(45) Date of Patent: Nov. 1, 2022

(54) DYNAMIC FORMULATION OF WATER-BASED DRILLING FLUIDS

(71) Applicant: Halliburton Energy Services, Inc., Houston, TX (US)

(72) Inventors: Sandeep D. Kulkarni, West Bengal (IN); Lalit N. Mahajan, Spring, TX (US); Xiangnan Ye, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 169 days.

(21) Appl. No.: 16/768,987

(22) PCT Filed: Jul. 12, 2019

(86) PCT No.: PCT/US2019/041638
§ 371 (c)(1),
(2) Date: Jun. 2, 2020

(87) PCT Pub. No.: WO2021/010945
PCT Pub. Date: Jan. 21, 2021

(65) Prior Publication Data

US 2021/0404334 A1 Dec. 30, 2021

(51) Int. Cl.
*E21B 49/08* (2006.01)
*E21B 21/06* (2006.01)
(Continued)

(52) U.S. Cl.
CPC ..... *E21B 49/086* (2013.01); *E21B 21/06* (2013.01); *E21B 21/08* (2013.01); *E21B 44/00* (2013.01);
(Continued)

(58) Field of Classification Search
CPC ..... E21B 49/086; E21B 21/06; E21B 21/08; E21B 44/00; E21B 49/088; E21B 2200/22
See application file for complete search history.

(56) References Cited

U.S. PATENT DOCUMENTS 5,519,214 A 5/1996 Houwen et al.
9,939,553 B2 4/2018 Jamison et al.
(Continued)

FOREIGN PATENT DOCUMENTS

WO 2015191073 12/2015

OTHER PUBLICATIONS

Salunda, "Quickly Track Drilling Mud with MudChecker™", Available Online at: https://web.archive.org/web/20170228005045/salunda.com/mudchecker/, Feb. 28, 2017, 4 pages.
(Continued)

*Primary Examiner* — Abby J Flynn
*Assistant Examiner* — Yanick A Akaragwe
(74) *Attorney, Agent, or Firm* — Kilpatrick Townsend & Stockton LLP

(57) ABSTRACT

Drilling fluid can be monitored throughout a drill site and at various stages of drilling operations. The drilling fluid may be analyzed to identify components that make the drilling fluid as well as the volume of each of the components, The volume of each component can be used, for example, to determine a percentage of water in a water-based drilling fluid and the average specific gravity of the water-based drilling fluid without further decomposition of the drilling fluid. The percentage of water and the average specific gravity can then be used to modify the drilling fluid, in real-time, based on conditions in the wellbore.

20 Claims, 5 Drawing Sheets

(51) Int. Cl.
*E21B 21/08* (2006.01)
*E21B 44/00* (2006.01)

(52) U.S. Cl.
CPC ..... *E21B 49/088* (2013.01); *E21B 2200/22* (2020.05)

(56) References Cited

U.S. PATENT DOCUMENTS

| | | | | |
|---|---|---|---|---|
| 2013/0192360 | A1* | 8/2013 | Jamison | E21B 21/00 73/152.19 |
| 2014/0202772 | A1 | 7/2014 | Kulkarni et al. | |
| 2014/0209384 | A1 | 7/2014 | Hanson | |
| 2018/0003048 | A1* | 1/2018 | Watson | G01N 33/2823 |
| 2018/0202246 | A1 | 7/2018 | Kleinguetl et al. | |
| 2019/0119999 | A1 | 4/2019 | Kleinguetl et al. | |

OTHER PUBLICATIONS

API, "Recommended Practice for Field Testing Oil-Based Drilling Fluids", 13B-2, Fifth Edition, 2012, 156 pages.
ANSI/API, "Recommended Practice for Field Testing Water-based Drilling Fluids", 13B-1, 2017, 121 pages.
Cheng et al., "A Technique for Predicting the Thermal Conductivity of Suspensions, Emulsions and Porous Materials", International Journal of Heat and Mass Transfer, vol. 13, No. 3, Mar. 1970, pp. 537-546.
Niekamp et al., "Thermal Properties of Bentonite-Water Dispersions Used for Modeling Foods", Journal of Food Science, vol. 49, No. 1, 1984, pp. 28-31.
International Application No. PCT/US2019/041638, "International Search Report and Written Opinion", dated Apr. 10, 2020, 9 pages.

* cited by examiner

DYNAMIC FORMULATION OF WATER-BASED DRILLING FLUIDS

The present disclosure relates generally to hydrocarbon extraction operations. More particularly, the present disclosure relates to analysis and optimization of wellbore drilling fluids.

BACKGROUND

Drilling within subterranean environments typically includes the use of one or more types of drilling fluids. Drilling fluids can may help keep the drill bit cool and remove the drill cuttings as the drill operates. Drilling fluids may be specially formulated to suit the particular characteristics of subterranean formations in a wellbore. For example, one or more additives can be added to the drilling fluid such as lubricants, thickeners, deflocculants, etc. In order to ensure consistent and safe drilling, the drilling fluid may be tested periodically on site between operations of the drill bit. This can ensure that other additives to the drilling fluid or contaminants have not altered essential properties of the drilling fluid.

Testing drilling fluids can be difficult and induce significant delays in drilling operations. Typically, testing of drilling fluids must be performed in controlled settings such as those at particular temperatures or pressures. Since drilling fluid returning from the wellbore is often too hot to test, the drilling fluid is pumped into tanks and cooled either by waiting a significant amount of time or through the use of a refrigerant. Once cooled, a drilling fluid can be chemically tested to determine whether the properties of the drilling fluid conform to the requirements of the subterranean environment and are thus safe for continued use in drilling operations.

DETAILED DESCRIPTION

Figure 1:
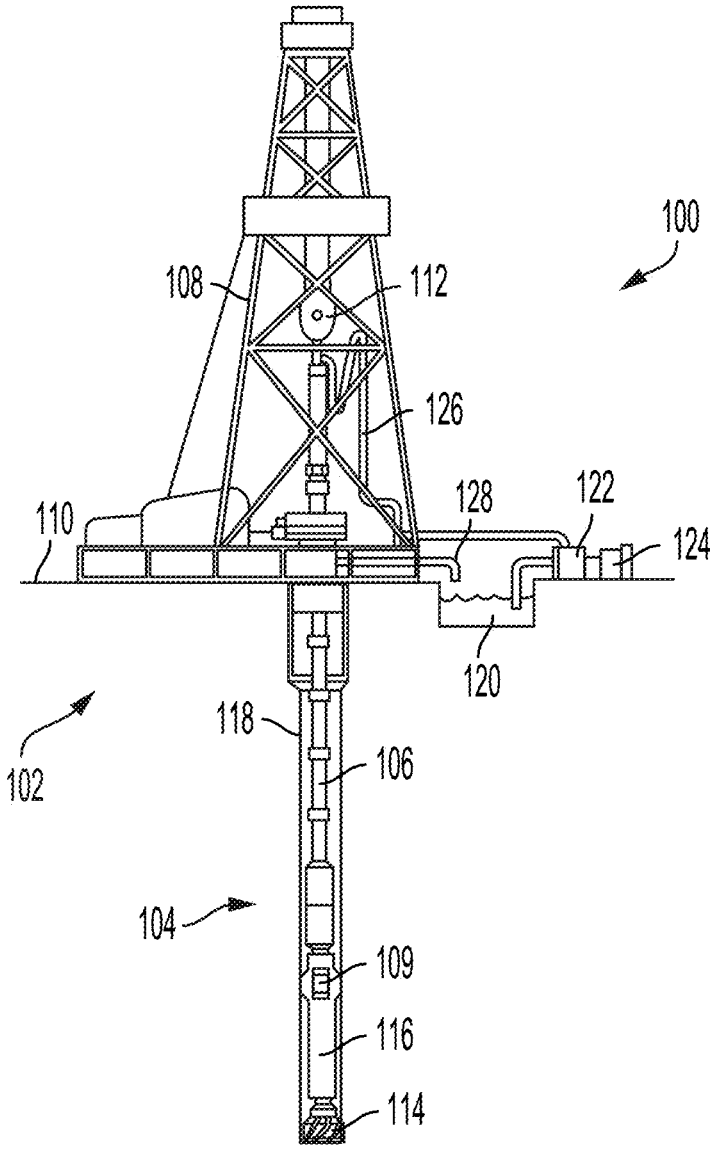
FIG. 1 is a cross-sectional view of a drilling system according to at least one aspect of the disclosure.

Certain aspects and features relate to measuring properties of water-based drilling fluids to ensure that the drilling fluids have the requisite properties for a particular subterranean environment and drilling operation. Further aspects and features relate to modifying water-based drilling fluids upon determining that the drilling fluids lack the requisite properties for a particular drilling operation or environment.

In some instances, testing the drilling fluid may require significant time before results can be obtained. In some instances, the delay may result in formation fluids may entering the wellbore, which may cause a blowout that can destroy the drilling system. In other instances, drilling operations may be halted indefinitely wasting valuable resources until test results can be obtained. Certain aspects and features of the disclosure provide for the monitoring of fluid at various locations of the drill site in real-time to provide for immediate optimization of the drilling fluid. The properties of the drilling fluid can be measured quickly under normal operating conditions in the field such that results can be obtained approximately immediately.

For instance, drilling fluid analysis may include using benchtop devices in laboratory to perform retort testing and chemical titration. Retort testing may heat a drilling fluid sample to approximately 930 degrees Fahrenheit to determine the volume percentage of water, the volume percentage of oil, and the volume percentage of retort solids. Chemical titration may be used to determine the water phase salinity of the brine. A mud balance may be used to determine the mud weight. The results of the retort testing, chemical titration and mud weight can be used to determine the volume percentage of the low-gravity solids and the high-gravity solids. The volume percentage of the low-gravity solids and the high-gravity solids can be used to calculate the average specific gravity of the water-based drilling fluid. The volume percentage of water, low-gravity solids, high-gravity solids, and the average specific gravity can be used to determine a number of different properties of the water-based drilling fluid.

In another instance, fluid analysis may occur at drill site without performing retort testing or chemical titration. For instances, a housing defining a fluid reservoir may receive a drilling fluid that is to be pumped into a wellbore. The drilling fluid can include brine, a low-gravity solids, and a high-gravity solids. A fluid analyzer can be used to analyze the drilling fluid and determine the drilling's suitability for use in a particular drilling operation. The fluid analyzer receives a target property value that corresponds to an optimal value of a property of the water-based drilling fluid. The fluid analyzer may then determine volume of the brine, a volume of the low-gravity solids, and a volume the high-gravity solids and calculates the average specific gravity of the drilling fluid. The average specific gravity and individual volumes can be used to determine the percentage of the drilling fluid that is water. The individual volumes, average specific gravity, and the percentage of the drilling fluid that is water can be used to determine a composition of the drilling fluid and whether the value of the property of the drilling fluid is approximately equal to the target property value.

The composition of drilling fluids may be selected to include particular properties based on the current drilling operations. For instance, the formation surrounding the wellbore may be composed of one or more materials that has a particular formation pore pressure gradient. Based on the one or more materials the drilling fluid composition can be selected to include a particular volume of low-gravity solids and high-gravity solids such that the drilling fluid exerts an approximate hydrostatic pressure on the formation. If the drilling fluid fails to exert the approximate hydrostatic pressure then formation fluids such as water, oil, natural gas, etc. may flow into the wellbore. The formation fluids may expand, especially gasses, as they rise up the wellbore and cause a blowout that may destroy the wellbore, drill bit, derrick, etc. On other hand, if the drilling fluid exerts a higher hydrostatic pressure than the approximate hydrostatic pressure then the formation may fracture. The fracture may cause lost circulation as the drilling fluid begins to fill the fracture, which may in turn cause a sudden reduction in pressure. The reduced pressure may cause the formation fluids to enter the wellbore and cause a blowout. The fluid analyzer may monitor the composition of the drilling fluid to ensure that the drilling fluid maintains particular properties throughout drilling operation.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a drilling system 100 that may employ one or more principles of the present disclosure. A wellbore may be created by drilling into the earth 102 using drilling system 100. Drilling system 100 may be configured to drive bottom hole assembly (BHA) 104 positioned or otherwise arranged at the bottom of a drill string 106 extended into the earth 102 from derrick 108 arranged at the surface 110. Derrick 108 includes kelly 112 that can be used to lower and raise drill string 106. BHA 104 may include a drill bit 114 operatively coupled to drilling tool 116, which can be moved axially within drilled wellbore 118 as attached to or part of drill string 106. The drill string may include one or more sensors 109 to obtain measurements associated with conditions of the drill bit and wellbore. The measurements may be returned to the surface through the cabling (not shown) or by one or more wireless transceivers (not shown). Sensors 109 can include, by example only, any sensor that produces a signal of characteristic associated with the drilling tool 116, wellbore 118, or subterranean environment. Sensors 109 may also produce a signal from which properties of the drilling fluid maybe derived. Examples of such characteristics can include lubricity, viscosity, temperature, hydrostatic pressure, density, a composition of the drilling fluid, and the like.

During drilling operations, drill bit 114 penetrates the earth 102 and thereby creates wellbore 118. BHA 104 provides control of drill bit 114 as it advances into the earth 102. Drilling fluid or "mud" from mud tank 120 may be pumped downhole using a mud pump 122 powered by an adjacent power source, such as a prime mover or motor 124. The drilling fluid may be pumped from mud tank 120, through stand pipe 126, which feeds the mud into drill string 106 and conveys the drill fluid to drill bit 114. The mud exits one or more nozzles (not shown) arranged in drill bit 114. After exiting drill bit 114, the mud circulates back to the surface 110 via annulus defined between wellbore 118 and drill string 106, and in the process returns drill cuttings and debris to the surface. The cuttings and mud mixture are passed through flow line 128 and are processed such that a cleaned mud is returned down hole through the stand pipe 126 once again.

Drilling fluids may perform a number of functions within the wellbore in addition to removing cuttings from the wellbore. For instances, drilling fluid composition may be designed to cool the drill bit, lubricate the drill bit and wellbore, minimize formation damage, remove cuttings, suspend cuttings within the drilling fluid when drilling operations are halted, control corrosion, control formation pressures, seal permeable formations, maintain wellbore stability, minimize environment contamination, combinations thereof, and the like. In some instances, the particular composition of the drilling fluid may be based on characteristics of the subterranean environment and the drill bit. For instance, the drilling fluid composition may be selected to ensure it is thixotropic such that a halt in operations does not allow the cuttings to sink to the bottom of the wellbore. If the cuttings are allowed to sink, unintended bridging can occur, which may cause wellbore cleaning problems and stuck pipe. Additives may be added or removed from drilling fluid to ensure the precise properties of the fluid are maintained given the real-time characteristics of the subterranean environment during drilling operations.

Drilling fluid may be tested on the surface before or after being pumped into the wellbore to ensure that the drilling fluid includes particular properties for a given subterranean environment. In some instances, a sample of the drilling fluid may be obtained from the drilling fluid returning from the wellbore before the drilling fluid reaches mud tank 120. In other instances, the drilling fluid may be tested after leaving mud tank 120 before being pumped back into the wellbore. Testing may identify the particular composition of the drilling fluid as well as the presence of contaminants such as hydrocarbons or cuttings. For example, the subterranean environment may be analyzed to determine a formation pressure of the rock surrounding the wellbore. The drilling fluid composition may be selected to exert a particular hydrostatic pressure that is approximately equal to the formation pressure. If hydrostatic pressure is less than the formation pressure then formation fluids such as oil, natural gas, water, etc. may seep into the wellbore and cause a blowout that may destroy the drilling system 100. If the hydrostatic pressure is higher than the formation pressure, the rock surrounding the wellbore may fracture causing lost circulation of drilling fluid. Testing the drilling fluid composition may ensure that the composition will provide the proper hydrostatic pressure.

Figure 2:
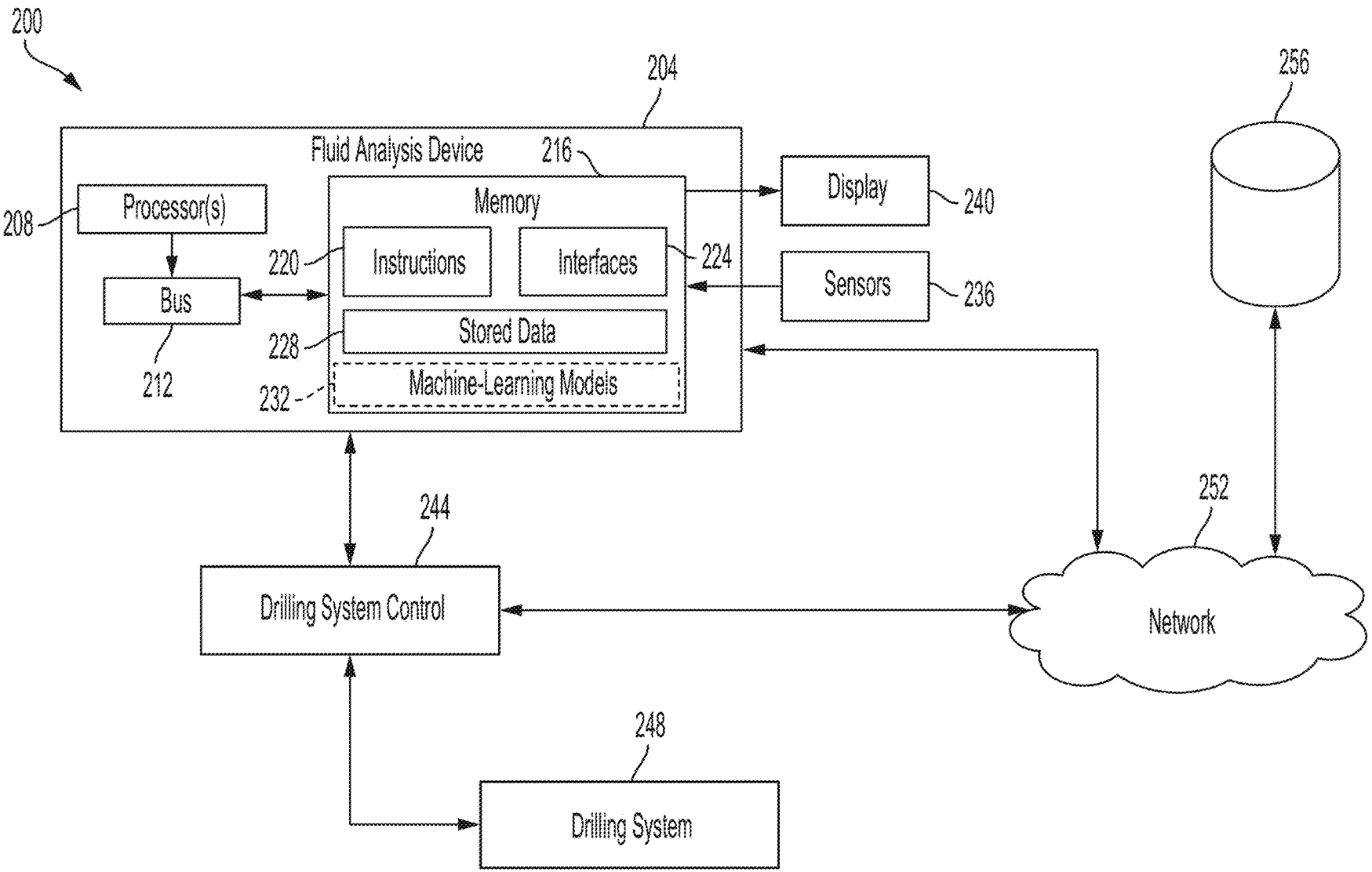
FIG. 2 is a block diagram of a drilling fluid analysis and control system according to at least one aspect of the disclosure.

FIG. 2 is a block diagram of a drilling fluid analysis and control system according to at least one aspect of the disclosure. Drilling fluid may be analyzed using fluid analysis device 204. Fluid analysis device 204 may positioned on site of drilling operations or in a remotely therefrom. Fluid analysis device 204 may be a handheld device or a built into a housing that defines a fluid reservoir.

Drilling fluid may be sampled and tested using fluid analysis device 204 before being pumped into the wellbore, while in the wellbore, or after exiting the wellbore. Fluid analysis device 204 can include one or more processors 208 coupled to memory 216 through a bus 212. Memory 216 may be a non-transitory computer-readable medium. Non-transitory computer-readable media may include any type of non-volatile memory. Examples of non-transitory computer-readable media include, but are not limited to, flash memory, magnetic memory, read-only memory, compact disks, electrically erasable programmable read-only memory (EEPROM), and the like.

Memory 216 stores instructions 220 and one or more interfaces 224 such as application programming interface and data interfaces that enable receiving or exporting data. Instructions 220 can include one or more sets of instructions that execute using one or more processors 208 to analyze an input drilling fluid. In some instances, instructions 220 can execute to control network communication, such as with drilling system control 244 and network 252, perform diagnostics to maintain proper operation of fluid analysis device 204, define a historical record of drilling fluid for a particular drilling system, combinations thereof, and the like.

Fluid analysis device 204 may analyze fluids using one or more sensors 236 that measure one or more properties of the drilling fluid. Examples types of measurements can include, but are not limited, percentage of water in a sample of drilling fluid; temperature; density; composition such as the volume in the drilling fluid of one or more of brine, high-gravity solids, low-gravity solids, petroleum, pressure, additives, dissolved gasses, or the like; total volume; drilling fluid type include oil-based, water-based, or gas-based; or the like. Sensor 236 generates an electrical signal as a representation of the measurement. The electrical signals may be digital or analog signals. Interface 224 can receive the electrical signals and convert them to an alphanumeric value associated with a particular measurement type or sensor type. The sensor measurements can be stored in stored data 228. In some instances, instructions 220 may direct the acquisition of the sensor measurements. For instance, instructions 220 may cause sensors 236 to obtain measurement once or in predetermined intervals. The predetermined interval may be based on a value of stored in stored data 228, output from machine-learning models 232, or received as a command from a remote device such as drilling system control 244. The predetermined interval may be changed to increase or decrease the measurements received within a given time period.

Stored data 228 may include historical records corresponding to one or more variations of drilling fluid. For instance, stored data 228 may include historical data associated each variation of drilling fluid that was in use at a particular drilling system. Stored data 228 may include every analysis of the drilling fluid used since drilling system 248 initiated operations. Stored data 228 may additionally include one or more data structures that provide an indication of how drilling fluid varied over time. For instance, the data structures may provide an indication as to how the viscosity of the drilling fluid changed. In some instances, the data structures may be correlated with characteristics of the wellbore or subterranean environment at the time of the variations. For instance, the change in viscosity may be correlated with a corresponding change in rock formations within the wellbore to provide an indication of the cause of the variation in drilling fluid. Stored data 228 may store each measured property of the drilling fluid as well as characteristics of the wellbore, subterranean environment, and subterranean formations. In some instances, the characteristics of the wellbore, subterranean environment, and subterranean formations may be received from one or more remote devices or drilling system control 244 over network 252. In other instances, fluid analysis device 204 may obtain the characteristics of the wellbore, subterranean environment, and subterranean formations from database 256 through network 252. The data structures may include raw data alphanumerical data or graphical user interfaces such as images, graphs, audio, video, etc.

Additional properties of the drilling fluid may be obtained from one or more machine-learning models 232. One or more machine-learning models 232 may process sensor measurements to derive an output indicating or representing properties of the drilling fluid that may not be directly measured using sensors 236. For example, a particular fluid analysis device may be able to obtain temperature measurements using a temperature sensor, while another fluid analysis device, lacking a temperature sensor, may derive a temperature measurement using one or more other sensors and machine-learning models 232.

A feature set may be defined that includes a set of one or more types of sensor measurements over a time interval. In some instances, a feature set may include at least one measurement from each sensor of fluid analysis device 204. In other instances, a feature set may include at least one measurement from one or more sensors such that multiple feature sets may be obtained from the measurements obtained from sensors 236. This may be advantageous when some sensors obtain measurements over different intervals from other sensors. For example, a first feature set may be defined for sensors that obtain measurements of the same first interval and a second feature set may be defined for sensors that obtain measurements over a different same interval. In still yet other instances, the measurements included with a feature set may be based on a particular sensor type. For example, temperature, volume, and pressure measurements may be grouped together in the same feature set and other measurements such as composition of the drilling fluid, type of drilling fluid, etc. may be grouped in another feature set.

The machine-learning models may be trained using stored feature sets from contemporaneously collected sensor data, historical data, or generated data. The machine-learning models 232 may be trained using supervised or unsupervised learning. In supervised learning, the feature set can include labeled data that indicates an expected value of one or more additional properties of the drilling fluid given a particular set of sensor measurements. For example, the feature set may indicate that drilling fluid with a particular volume of brine, low-gravity solids, and high-gravity solids is made up of a particular percentage of water. The machine-learning model may use the feature set, as input, and the labels, as expected output, to define one or more functions that will output the expected additional one or more properties of the drilling fluid. The accuracy of the one or more functions, and the machine-learning model, may depend on the number of feature sets used to train the machine-learning model. Examples of algorithms that can be used for supervised learning include, but is not limited to, regression such as random forest, linear and non-linear; Bayesian statistics; neural networks; decision trees; Gaussian process regression; nearest neighbor; long short-term memory; deep learning algorithms; combinations thereof; and the like.

In unsupervised learning, the feature sets may not be labeled such that the machine-learning model may not have access to the expected values of the one or more additional properties associated with a given input feature set. Since the expected values are unknown, the machine-learning model may use different algorithms from those used during supervised learning. Unsupervised learning may focus on identifying correlations between two or more measurements of a feature set and (2) one or more properties and another feature set. Unsupervised learning may identify one or more sensor measurements that can indicator for an estimated value of an additional property, presence or absence of a particular component of the drilling fluid, correlated properties, new properties, combinations thereof and the like. In some instances, the measurements of a feature set may be weighted before or during processing by a machine-learning model. For example, the machine-learning model may indicate that certain measurements are a better indicator for a particular property, such as water percentage of the drilling fluid. Those measurements may be weighted higher when processing future feature sets then other measurements. Examples of unsupervised learning algorithms for machine-learning models include, but are not limited to, clustering, neural networks, outlier detection, combinations thereof, or the like.

The machine-learning models may be trained over a predetermined interval of time that can be determined based on the size of the feature sets and the number of features included in the training data. In some instances, training may continue until predetermined threshold is met. For example, training may continue until a predetermine number of feature sets are processed by the machine-learning models. In another example, training may continue until the machine-learning model reaches a predetermined accuracy value. Accuracy may be determined by passing labeled feature sets into the machine-learning model and matching the output to the label. In other instances, accuracy may be determined based on user analysis of the training process, the output of the machine-learning models on contemporaneously collected measurements, or the rate at which the machine-learning model generates an output from a given input. In some instances, the machine-learning models may be continuously trained, first using the training feature sets and then using contemporaneously obtained measurements from sensors 236 to further improve the accuracy of machine-learning models 232.

An accuracy value associated with machine-learning models 232 may be used to trigger training or re-training of machine-learning models 232. If the accuracy value falls below a threshold then training or re-training may be triggered. In the instance of re-training, machine-learning models 232 may continue to analyze drilling fluid, but the output may include an indication that re-training has occurred to warn an operator that the output may not be up to the threshold level of accuracy. In some instances, the output may be compared to a second and lower accuracy threshold, such that if accuracy falls below this second threshold, the machine-learning model may be discarded rather than re-trained. New machine-learning models may be instanced and trained using historical measurements, previously captured measurements stored in stored data 228, manufactured measurements, contemporaneously captured measurements from sensors 236, combinations thereof, or the like. For example, the machine-learning model may be trained from measurements obtained from a first drilling fluid. Fluid analysis device 204 may be used to analyze a second drilling fluid of another drill site using a different drilling fluid composition or drilling in a different subterranean environment. The second drilling fluid may have properties that do not corresponds to properties of the first type of drilling fluid. As a result, the trained machine-learning model not be accurate in determining the additional one or more properties of the second drilling fluid without first being trained from measurements associated with the second drilling fluid.

Fluid analysis device 204 may output the measured and derived properties of the drilling fluid to drilling system control 244, one or more databases 256, or through a display 240. Display 240 may be incorporated into fluid analysis device 204 such as attached to a surface of the device separated from fluid analysis device 204. Display 240 may display one or more user interfaces that provide a graphical representation of the measured and derived properties of the drilling fluid. Drilling system control 244 can control the operation of drilling system 248. In some instances, the output from fluid analysis device 204 may be used to reformulate the drilling fluid that is in operation. For instance, drilling system control 244 may receive the output and determine that the properties of the current drilling fluid may not be capable of producing an intended hydrostatic pressure on the formations surrounding the wellbore. Drilling system control 244 may generate a request to drilling system 248 to increase the density of the drilling fluid by, for example, increasing the volume of the high-gravity solids within the drilling fluid. Drilling system control may generate multiple requests each request indicating a modification to the drilling fluid or a composite request that includes each modification to the drilling fluid in a single request. In some instances, drilling system control 244 may generate a new drilling fluid composition and output the new drilling fluid composition to drilling system 248.

Drilling system 248 may be drilling system 100 of FIG. 1 and include one or more control devices that manipulate the operations of drilling system 248 and the composition of drilling fluids. For example, drilling system 248 may include one or more tanks of individual drilling fluid components that can be mixed together to form a particular drilling fluid with particular desirable properties. Drilling system 248 may receive an indication of the particular composition of drilling fluid that is to be used in drilling operations or a request to modify the drilling fluid that is currently in use from drilling system control 244. In some instances, fluid analysis device 204 may transmit the new drilling fluid composition or the modification to the drilling fluid direct to drilling system 248.

One or more fluid analysis devices such as fluid analysis device 204, drilling system control 244, one or more databases 256 may communicate via network 252. Network 252 may include one or more interconnected networks. Examples of networks include, but are not limited to, local area networks, wide area networks, cellular networks, WiFi networks, cloud networks, combinations thereof, and the like. Fluid analysis device 204 can include one or more network interfaces that operate along with one or more transceivers (not shown) to enable fluid analysis device 204 to communicate with remote devices. The one or more transceivers can enable wired or wireless communications with drilling system control 244 and network 252.

Figure 3:
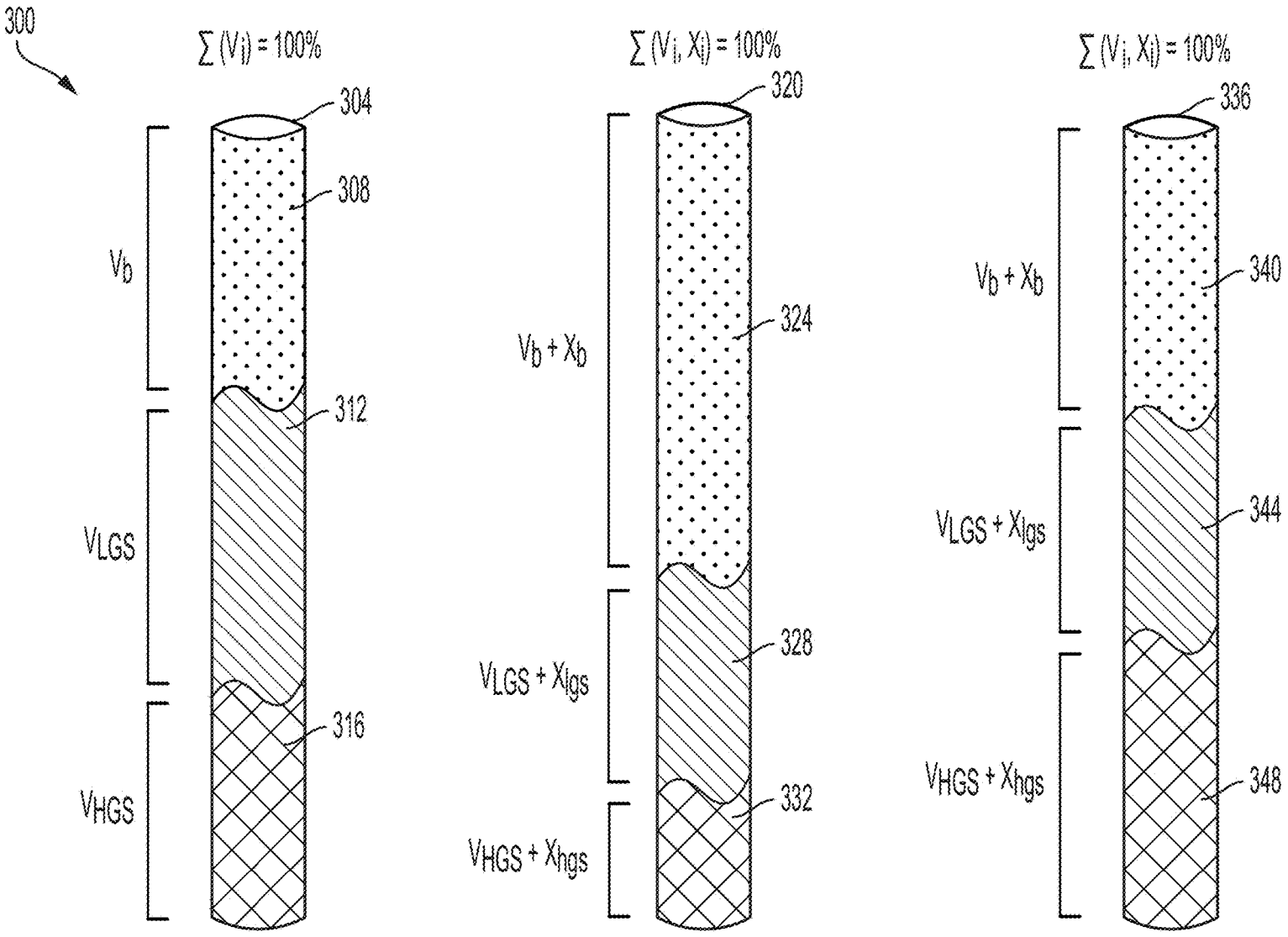
FIG. 3 is a block diagram representing an analysis of drilling fluids according to at least one aspect of the present disclosure.

FIG. 3 is a diagram of representing an analysis of drilling fluids according to at least one aspect of the present disclosure. Drilling fluid analysis may use one or more sensor measurements to derive additional properties of the drilling fluid. Drilling fluids may include oil based, water based, or gas dissolved drilling fluids. The composition of the drilling fluid and the additives that are added or removed may be based on the type of drilling fluid. For instance, water-based drilling fluids such as drilling fluid 304 may include brine 308, a low-gravity solids 312, and a high-gravity solids 316. The brine 308 may be made up of any combination of an alkali metal and a halogen dissolved in water. Examples of salts include, but are not limited to, sodium chloride, potassium chloride, and the like. In some instances, a salt table for a given salt may be used to determine the salinity of the brine based on the concentration of the particular salt in a volume of water.

The low-gravity solids 312 and high-gravity solids 316 can provide a particular density to the drilling fluid such that the drilling fluid may be capable of exerting a particular hydrostatic pressure on the rock formations surrounding a wellbore. In some instances, low gravity solids may have a density of approximately 2.60 g/cm$^3$. The high-gravity solids 316 may have a higher density then the low-gravity solids. The high-gravity solids may include barite, hematite combinations thereof, or the like. The density of barite is between 4 g/cm$^3$ and 4.20 g/cm$^3$ and the density of hematite is 5.505 g/cm$^3$. The relative volume of the high-gravity solids and low-gravity solids within the drilling fluid can be varied to achieve a particular density of the drilling fluid. Increasing the density of the drilling fluid, by increasing the relative of the volume low-density solids or high-density solids, can generate a corresponding increase in the hydrostatic pressure exerted by the drilling fluid in the wellbore.

Water-based drilling fluids may be tested to determine the percentage of water and the average specific gravity (ASG) of the drilling fluid. In instances, where direct measurements may be unavailable, the percentage of water in the drilling fluid can be determined by first determining the volume of each in the drilling fluid. For example, water-based drilling fluids include brine, $V_b$ 308, a low-gravity solids, $V_{lgs}$ 312, and a high-gravity solids, $V_{hgs}$ 316. The volume of the drilling fluid may be expressed by the relative volumes of each of the principle components $\Sigma v_i = v_b + v_{lgs} + v_{hgs} = 1$. The density of the drilling fluid or mud weight can be expressed as $\Sigma v_i \rho_i = v_b \rho_b + v_{lgs} \rho_{lgs} + v_{hgs} \rho_{kgs}$, where $\rho$ is the density. The density $\rho_b$ of the brine 308, which can be approximately 1 g/cm$^3$ to 2.4 g/cm$^3$. The precise value of the particular brine may be determined from a salt that corresponds to the particular salt used in the brine. The density of the low-gravity solids low gravity solids, $\rho_{lgs}$ can be approximately 2.60 g/cm$^3$, and the density of the high-gravity solids $\rho_{hys}$ can be approximately 4.20 g/cm$^3$ if barite is used and approximately 5.505 g/cm$^3$ hematite is used.

The addition of solids into liquids to form the brine, low-gravity solids and high-gravity solids may cause an increase in the thermal conductivity of the drilling fluid. Thermal conductivity of the drilling fluid can be modelled using the base liquid, which is the continuous phase of each component, and the solids, which is the discontinuous phase of each component, as well as the relative volume percentages of each component, $V_i$. Thermal conductivity can be represented by $$\sum f(TC_i, V_i) \text{ where } f(TC_i, V_i) = \frac{1}{R_{e,i}}.$$

$R_{e,i}$ can be expressed as $$R_{e,i} = \frac{1}{\sqrt{C_i(k_{c,i} - k_{d,i})(k_{c,i} + B_i(k_{d,i} - k_{c,i}))}} * \ln\frac{\sqrt{k_c + B_i(k_{d,i} - k_{c,i})} + \frac{B_i}{2}\sqrt{C_i(k_{c,i} - k_{d,i})}}{\sqrt{k_c + B_i(k_{d,i} - k_{c,i})} - \frac{B_i}{2}\sqrt{C_i(k_c, i - k_{d,i})}} + \frac{1 - B_i}{k_{c,i}}$$

where $k_{d,i}$ and $k_{c,i}$ can represent the thermal conductivity of the discontinuous phase and continuous phase respectively of a particular component such that $g(TC_i) = k_{d,i} + k_{c,i}$, $B_i$ can represent the volumetric fraction of the base fluid portion of the particular component, and $C_i$ can represent the volumetric fraction of the solids portion of the particular such that $h(v_1) = B_i + C_i$. $R_{e,i}$ may be solved for each component of the drilling fluid and summed to determine the thermal conductivity of the such that $$\sum f(TC_i, V_i) = f(TC_b, V_b) + f(TC_{lgs}, V_{lgs}) + f(TC_{hgs}, V_{hgs}) = \frac{1}{R_{e,b}} + \frac{1}{R_{e,lgs}} + \frac{1}{R_{e,hgs}} = TC.$$

In some instances, $k_{d,i} + k_{c,i}$ and $B_i + C_i$ may be refined according to the types of solids and the quantity of distinct types of solids in the drilling fluid.

The models for the volume, density, and thermal conductivity may be used to derive the values for each of $v_b$, $v_{lgs}$, and $v_{hgs}$. The relative volumes can be used to define the average specific gravity for the drilling fluid using $$ASG = \frac{v_{lgs}\rho_{lgs} + v_{hgs}\rho_{hgs}}{v_{lgs} + v_{hgs}}.$$

The equations of this and preceding paragraphs may be used to model the respective relative volumes, densities, thermal conductivities, and the average specific gravity of the fluids, but other such equations may be used in addition to or alternatively to model the respective relative volumes, densities, thermal conductivities, and the average specific gravity of the fluids. Examples of types of model equations may include, but are not limited to be a power function, an exponential function, a polynomial function, a linear function, a combination thereof, or the like. The values of individual coefficients may be determined from measuring properties of the fluid using one or more sensors or determined using machine-learning models using one or more sensors measurements as input. In some instances, the equations themselves may be modified using machine-learning models to derive an accurate value of the relative volumes of each component of the drilling fluid. For example, the modelled equation for $R_{e,i}$ above, may be modified using machine-learning models by processing labeled drilling fluid over time.

The relative volumes $V_i$ of the drilling fluid components can be used to determine percentage of water within the brine using, for example, the machine-learning models or a salt table. The percentage of water in the drilling may be used to improve fluid formulation and fluid properties of the drilling fluid, manage real time fluid component dosing, stabilize formation, stabilizing drilled formation, manage wellbore hydraulics, or the like. For example, analysis of a current fluid, and the percentage of water within that fluid, may determine a current hydrostatic pressure exerted by the fluid. The current hydrostatic pressure may be compared to a target hydrostatic pressure that is selected to stabilize the formation and prevent unintended fractures and lost circulation. The difference between the current hydrostatic pressure and the target hydrostatic pressure can be used to modify the drilling fluid such that the drilling fluid can exert the target hydrostatic pressure. For example, the more barite may be added to increase the density of the drilling fluid and increase a hydrostatic pressure exerted by the drilling fluid or more brine or low-gravity solids may be added to reduce the overall percentage of high-gravity solids with in the drilling fluid to lower the hydrostatic pressure.

For instance, drilling fluid 304 may be modified to correspond to drilling fluid 320 or 340 based on the properties of drilling fluid 304 and the characteristics of the wellbore or subterranean environment. Using the same example above, if the target hydrostatic pressure is higher than the hydrostatic pressure exerted by drilling fluid 304, then relative volumes of components of the drilling fluid 304 may be modified by adding or subtracting one or more components to achieve drilling fluid 336. In some instances, the overall volume of the drilling fluid may not change. Therefore, modifying the composition of a drilling fluid may varying the percentage of each component such that increasing one necessitates decreasing another. In other instances, the volume may be changed to achieve an intended concentration.

Drilling fluid 304 includes an overall volume of $\Sigma v_i = 1$, whereas the volume of drilling fluid 320 and 336 may be expressed as $\Sigma(v_i, x_i) = 1$ where $x_i$ is an amount that is added to or subtracted from the volume of a component, $v_i$. Drilling fluid 336 may be represented as having a larger volume of high-gravity solids 348 due to the higher density of the high-gravity solids than the high-gravity solids 316 of drilling fluid 304. There is proportion decrease in the relative volume of low-gravity solids 344 and an increase in brine 340. On the other hand, if it is determined that the target hydrostatic pressure is lower than the current hydrostatic pressure of 304, then the volume of the high-gravity solids may be decreased. For example, drilling fluid 320 may have a lower overall density due to the lower relative volume of high-gravity solids 332 and low-gravity solids 328. There may be a higher volume of brine 324 since brine has a lower density then either of the high-gravity solids 332 and low-gravity solids 328.

The volume of any component of the drilling fluid may be added or subtracted while maintaining the same volume by diluting the drilling fluid a component. For instance, drilling fluid 320 has a higher brine 324 volume than drilling fluid 304 and a lower low-gravity solids 328 and high-gravity solids 332. This can be achieved by adding additional brine to drilling fluid 320 while the drilling fluid is in a storage tank thereby increasing the percentage of the drilling fluid that includes brine while decreasing the percentage of the drilling fluid that includes low-gravity solids or high-gravity solids. A sensor on a valve of the storage tank may be used to ensure that the same volume of the new drilling fluid such as drilling fluid 320 or drilling fluid 336 is pumped into the wellbore as the previous drilling fluid.

Figure 4:
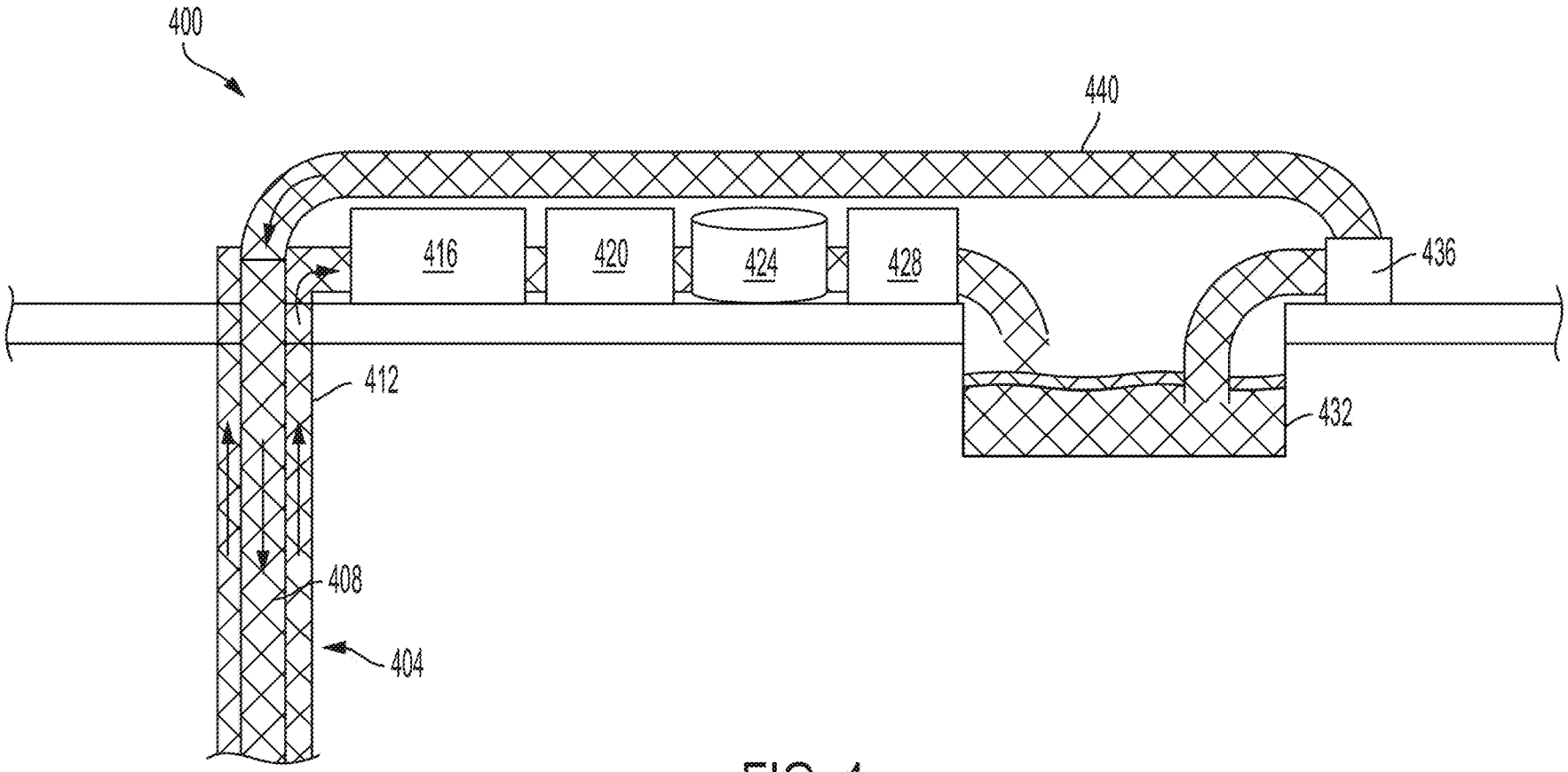
FIG. 4 is a block diagram of a drilling fluid analysis system according to at least one aspect of the present disclosure.

FIG. 4 is a block diagram of a drilling fluid analysis system 400 according to at least one aspect of the present disclosure. Drilling fluid analysis system 400 may include a drilling fluid tank that stores drilling fluid to be pumped into wellbore 404. In some instances, the drilling fluid tank may include multiple tanks, one tank for each component of the drilling fluid. In those instances, one or more valves may be used to pump the various components into a mixing tank The drilling fluid in the mixing tank may include each of the components and each additive in a particular ratio such that the overall drilling fluid includes particular intended properties.

The drilling fluid may be pumped into the inside of drill stem 408 where the drilling fluid may pass through bit nozzles of the drill bit at relatively high velocity. The high velocity of the drilling fluid may improve cleaning of drill bit and wash cuttings from the bottom of wellbore 404. The drilling fluid may exert a hydrostatic pressure on the surrounding formations such that the pressure may cause, among other things, the drilling fluid to flow upwards through channel 412 between drill stem 408 and the surrounding formations. The drilling fluid may exit the wellbore through annuls where it may be processed.

For instance, the returning drilling fluid may include drill cuttings and potentially one or more contaminants such as metals, dissolved gasses such as natural gas, hydrocarbons, added water, combinations thereof, and the like. The drill cuttings and contaminants may alter one or more properties of the drilling fluid that may render the drilling fluid unsuitable for use in wellbore 404. The drilling fluid may be processed by one or more shale shakers 416, degassers 420, and desander centrifuges 424 to filter the drill cuttings and contaminants from the drilling fluid. Shale shakers remove larger particulates in the drilling fluid by passing the drilling fluid over a vibrating wire-cloth screen. The drilling fluid and smaller particulates may pass through the wire-cloth screen while the larger particulates may be output into a separate storage for further processing. The drilling fluid may then be transferred to a degasser 420 may expand the gasses in the drilling fluid pumping the drilling fluid into a vacuum chamber and increasing the surface area of the drilling fluid. The expanding gasses may escape through one or more baffle plates. If the gas volume is high, a mud gas separator may be used (alternatively or in combination with the degasser) to route the gas to a flaring area where it may be ignited.

The desander centrifuge 424 may remove finer particulates in the drilling fluid using centrifugal forces. The denser particulates may be pushed downward while the lighter drilling fluid may be pushed upward where the drilling fluid may exit the desander centrifuge 424. Though the shale shakers 416, degassers 420, and desander centrifuges 424 are represented in a particular order between wellbore 404 and mud tank 432, the drilling fluid may be processed by each of shale shakers 416, degassers 420, and desander centrifuges 424 in any particular order. In addition, the drilling fluid may be processed by each of shale shakers 416, degassers 420, and desander centrifuges 424 once or multiple times in any particular order. In some instances, the drilling fluid may processed by one or more of shale shakers 416, degassers 420, or desander centrifuges 424, but not necessarily each of shale shakers 416, degassers 420, and desander centrifuges 424.

The drilling fluid may be then be pumped into fluid analyzer 428, which may be included within a housing that defines a fluid reservoir that stores a portion of the drilling fluid for testing by fluid analyzer 428. The drilling fluid may be received into the fluid reservoir by an inlet of the housing. Fluid analyzer can analyze the drilling fluid to detect the components therein and as well as the properties of the drilling fluid. Fluid analyzer may ensure that the drilling fluid has one or more requisite properties for the particular drilling conditions and subterranean environment and if not, initiate remedial action. For instance, if the drilling fluid does not include the requisite properties, the drilling fluid may be prevented from being pumped into the wellbore. For instance, if the drilling fluid does not include the requisite properties, the drilling fluid may be prevented from being pumped into the wellbore. In some instances, a different drilling may be pumped into the wellbore instead such as standardized drilling fluid.

In other instances, drilling operations may be halted to prevent damage to the drill bit, wellbore, or subterranean environment that may be caused by an improper drilling fluid. Fluid analyzer may indicate what properties are missing or what properties are present that should be absent from the drilling fluid as well as an indication as to what components and additives need to be added or removed from the drilling, and in what quantities or volumes, to achieve a drilling fluid with the requisite properties. Fluid analyzer may issue one or more commands to a controller that causes the modifications to the drilling fluid. In some instances, the modification may occur within the fluid reservoir of fluid analyzer 428. In other instances, the drilling fluid may be pumped into mud tank 432 where the modification may occur. The modified drilling fluid may be tested again by fluid analyzer 428 before being pumped into mud tank 432 or using another fluid analyzer (not shown) of mud tank 432 to ensure that the modified drilling fluid includes the requisite properties.

Once analyzed by fluid analyzer 428, the drilling fluid may be pumped into mud tank 432. If modifications are needed and were not previously performed by fluid analyzer 428, the drilling fluid may be modified within mud tank 432. Otherwise, a fluid analyzer of mud tank 432 may analyze the drilling fluid to confirm that the drilling fluid or modified drilling fluid includes the requisite properties. Mud pump 432 may then pump the confirmed drilling fluid out of mud tank 432 through pipe 436 and back into wellbore 404. The drilling fluid may be continuously pumped into the wellbore such that drilling fluid is also continuously exiting the wellbore and processed by shale shakers 416, degassers 420, desander centrifuges 424, and fluid analyzer 428. Since the drilling fluid is pumped through a closed loop from wellbore 404, through processing into mud tank 432, and back to wellbore, the fluid analyzers of system 400 may analyze the drilling fluid in regular intervals such as ever second, 1 minute, 5 minutes, 30 minutes, or any other predetermined time interval. Alternatively or additionally, the fluid analyzers may analyze the drilling fluid upon detecting a change in drilling conditions such sudden variations in pressure detected in the wellbore, loss of drilling fluid volume, detection of formation fluids or other particular contaminants in the drilling fluid, or the like.

Fluid analyzers may be positioned throughout system 400 including in the wellbore, before or after each process stage 416, 420, 424, before being pumped into mud tank 432, before the drilling fluid is modified if needed, after the drilling fluid is modified, in mud tank 432, or in pipe 440. Frequent testing may ensure that the drilling fluid can be safely reused, which can reduce the volume of drilling fluid necessary to store on site during drilling operations. In some instances, fluid analyzers may test the drilling fluid prior to being pumped into wellbore 404 for the first time to form a baseline for the drilling fluid. Fluid analyzers be integrated into a structure such as fluid analyzer of 428 or mud tank 432, at fixed locations. Alternatively or additionally, fluid analyzers may be hand-held devices operated by a field engineer who, for example, may obtain a sample of the drilling fluid at any location of system 400 and analyze the drilling fluid using the sample.

In other instances, a drill site may use a single fluid analyzer such as fluid analyzer 428 or one based in mud tank 432. In those instances, the drilling fluid may be routed to the fluid analyzer during various phases of drilling operations such that the fluid analyzer tests the properties of the drilling fluid before, after, or before and after the drilling fluid is pumped into the wellbore. In some instances, the drilling fluid may be tested by other fluid analyzers (not shown) at various locations of the drilling operation including at locations within the wellbore.

In some instances, fluid analyzers such as fluid analyzers 428 or one based in mud tank 432 may identify the components or properties of drilling fluid under no particular conditions. Fluid analyzers may analyze a sample of the drilling fluid under any particular temperature or pressure. In other instances, the temperature and pressure of the drilling fluid may be controlled. For example, a sample of the drilling fluid may analyzed at approximately 120 degree Fahrenheit and at 1 atmosphere of pressure. In some instances, the temperature and pressure may be kept static or while the fluid analyzer processes a drilling fluid sample.

Figure 5:
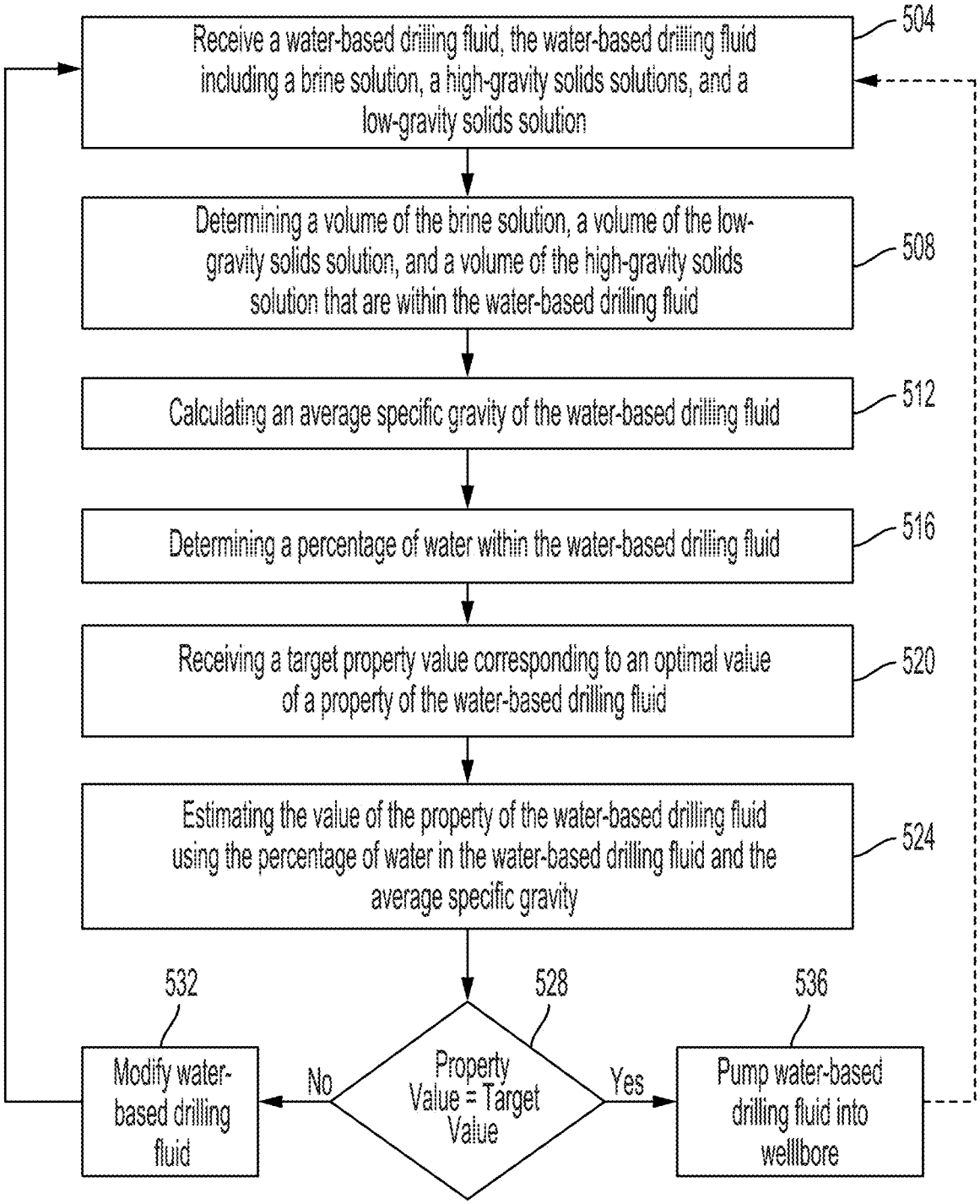
FIG. 5 is a flowchart of a process for controlling the composition of drilling fluid during drilling operations according to at least one aspect of the present disclosure.

FIG. 5 is a flowchart of a process for controlling the composition of drilling fluid during drilling operations according to one aspect of the present disclosure. At block 504, a drilling fluid is received for pumping into a wellbore during drilling operations. In some instances, the drilling fluid may be a water-based drilling fluid. The water-based drilling fluid may be made up of components such as, but not limited, brine, a low-gravity solids, a high-gravity solids, one or more additives, combinations thereof, and the like. Examples of additives include, but are not limited to, bentonite, natural & synthetic polymers, asphalt. and gilsonite, sand, calcium carbonate, barite, hematite, xanthan gum, guar gum, glycol, carboxymethylcellulose, polyanionic cellulose (PAC), starch, anionic polyelectrolytes, lubricants, deflocculants, shale inhibitors, fluid loss additives, silica, clay, combinations thereof, and the like. In other instances, the drilling fluid may be an oil-based or gas-based drilling fluid. Oil-based and gas-based drilling fluids may include an oil-based or gas-based, respectively, in place of the brine. Oil-based and gas-based drilling fluids may include the same or similar one or more additives as described above.

At block 508, the relative volumes of the principle components are determined. The principle components may include the brine, the low-gravity solids, and the high-gravity solids. Determining the relative volume of principle component may include using the volume model $\Sigma v_i = v_b + v_{lgs} + v_{hgs} = 1$, the density model, $\Sigma v_i \rho_i = v_b \rho_b + v_{lgs} \rho_{lgs} + v_{hgs} + \rho_{hgs}$, where $\rho$ is the density of the respective principle component, and the thermal conductivity model $$\sum f(TC_i, V_i) \text{ where } f(TC_i, V_i) = \frac{1}{R_{e,i}}.$$

The three models can be used to solve for $v_b$, $v_{lgs}$, and $v_{hgs}$ to identify the percentage of the drilling fluid that is made up of each principle component.

In some instances, determining the principle components can include training a machine-learning model based using historical drilling fluids or generated data. The machine-learning model may be trained using supervised or unsupervised learning. Once trained the machine-learning model may process one or more sensor measurements as input and generate an output that indicates the relative volumes of each of the principle components. In some instances, the machine-learning model may additionally output the relative volumes of any additives if present.

At block 512, the average specific gravity of the drilling can be determined, using the relative volumes of the principle components. In some instances, since the densities of the low-gravity solids and the high-gravity solids are significantly greater than that of the brine, the average specific gravity of the drilling fluid may be determined using only the low-gravity solids and the high-gravity solids. For example, the average specific gravity can be determined using the model:

$$ASG = \frac{v_{lgs}\rho_{lgs} + v_{hgs}\rho_{hgs}}{v_{lgs} + v_{hgs}}.$$

In other instances, the volumes of each of the principle components may be used to determine the average specific gravity. In still yet other instances, the machine-learning model may process the volumes and the densities of each of the principle components to derive the average specific gravity.

At block 516, the percentage of the drilling fluid that is water can be determined. The percentage of water value can be determined using the machine-learning model or a salt table based on the particular salt of the brine. At block 520, a target property value is received. The target property value may be an optimal value for a property of the drill fluid, for example, based on the current conditions of the drill bit or subterranean environment. Examples of property includes, but are not limited, lubricity, thickness, viscosity, a hydrostatic pressure exerted by the drilling fluid, ability for the drilling fluid to cool the drill bit, a sealing capability such as when formation fractures or drilling operations cease, combinations thereof, and the like. The property may include any characteristic of the drilling fluid or any component, or additive that make up some or all of the drilling fluid. The target property value determined based on one or more measurements by sensors that indicates a state or composition of the subterranean environment, drill bit, or wellbore. For example, the target property value may be a target pressure value that, based on the current conditions of the subterranean environment, is high enough to prevent formation fluids from entering the wellbore, but low enough to prevent unintended fracturing and lost circulation.

The target property value may change in-real time as drilling operations progress. In some instances, the new target property value may be received automatically upon one or more sensors in the wellbore detecting a change in the drilling operations or subterranean environment. In other instances, the new target property value may be continuously derived by a field engineer. At block 524, the value of the property of the received water-based drilling can be estimated. In some instances, the value of the property may be estimated using percentage of water in the drilling fluid determined block 516 and the average specific gravity of the drilling fluid at block 512. In other instances, the value of the property may be measured using one or more sensors. In still yet other instances, one or more machine-learning models may be used to derive the value for the property.

At block 528, the target property value can be compared to the estimated property value of the water-based drilling fluid. If the target property value differs from the estimated property value by more than a threshold amount then the process may continue at block 532 where the water-based drilling fluid may be modified such that the estimated value of the property of the modified water-based drilling fluid is approximately equal to the target property value. In the pressure example above, the hydrostatic pressure exerted by the water-based drilling fluid can be increased by adding barite or hematite to increase the density of the water-based drilling fluid. The hydrostatic pressure exerted by the water-based drilling fluid can be decreased by increasing the volume of the brine or low-density solids relative to the volume of the high-gravity solids in the water-based drilling fluid. Once modified to increase or decrease the value of the property, the process may return to block 504, in which the modified water-based drilling fluid can be re-received and re-tested to determine if the value of the property of the modified water-based drilling fluid now approximately equals the target property value.

If property value of the water-based drilling fluid is approximately equal to the target property value, then the process continues at block 536 where the water-based drilling fluid is pumped into the wellbore during drilling operations. The returning water-based drilling fluid may be processed to remove drill cuttings and any potential contaminants. Once processed, the process may return to block 504 where the returning water-based drilling fluid may be analyzed again under 504-524 to determine if the properties of the returning water-based drilling fluid, such as the hydrostatic pressure potential are still approximately equal to the target pressure value.

In some instances, blocks 504-536 may be repeated indefinitely or until drilling operations are halted. Blocks 504-536 may be executed in real-time to modify the component composition of the drilling fluid as drilling operations continue and conditions in the wellbore change. If the target property value changes, for example, due to the state of the subterranean environment, wellbore, drill bit, or any other aspect of the drilling operations, then the composition of the water-based drilling fluid can be immediately modified to include optimal property values to complement the new state of the subterranean environment, wellbore, drill bit or any other aspect of the drilling operations.

The process of FIG. 5 may alternatively or additionally analyze multiple properties of drilling fluids in real-time and automatically modify the drilling fluids. For example, block 520, may include receiving a target value for multiple properties at once. The values of each of the corresponding properties of the drilling fluid may be estimated at block 524 and compared at block 528. At block 528, it may be determined whether the estimated value of each property differs from the target value for the corresponding property. Modifying the drilling fluid may include modifying the drilling fluid such that each the value of each of properties can be increased or decreased as needed. This may include adding additional components, additives, or the like, removing components, additives, or the like, or formulating a brand new drilling fluid that includes each of the properties at the requisite values.

Blocks 504-532 may be executed once to ensure that each of multiple properties of the drilling fluid conform to requirements of the subterranean environment. Alternatively, blocks 504-532 may be executed multiple times, once for each of one or more properties to be tested. Blocks 504-532 can be executed in series or in parallel such that multiple properties can be tested at the same time and the drilling fluid can be modified at the same time. Each block of the process of FIG. 5 can be executed in order or out-of-order. In addition, within a single execution of the process of FIG. 5, each block may be executed once or more than once.

In some aspects, systems and methods for analyzing and controlling drilling fluids are provided according to the following examples. As used below, any reference to a series of examples is to be understood as a reference to each of those examples disjunctively (e.g., "Examples 1-4" is to be understood as "Examples 1, 2, 3, or 4").

Example 1 is a system comprising a housing defining a fluid reservoir, the housing including an inlet to receive a water-based drilling fluid that is configured to be pumped into a wellbore, the water-based drilling fluid comprising of brine, a low-gravity solids, and a high-gravity solids; a fluid analyzer comprising one or more processors and a non-transitory computer-readable medium storing instructions that when executed by the one or more processors cause the fluid analyzer to perform operations including: receiving a target property value that corresponds to an optimal value of a property of the water-based drilling fluid; determining a volume of the brine, a volume of the low-gravity solids, and a volume the high-gravity solids that are within the water-based drilling fluid; calculating, using the volume of the low-gravity solids and the volume of the high-gravity solids, an average specific gravity of the water-based drilling fluid; determining, using the volume of the brine, a percentage of water that is within the water-based drilling fluid; calculating, using the average specific gravity and the percentage of water, a value of the property of the water-based drilling fluid; and determining a fluid composition of the water-based drilling fluid such that the value of the property of the water-based drilling fluid is approximately equal to the target property value.

Example 2 is the system of example(s) 1, wherein determining the volume of the brine, the volume of the low-gravity solids, and the volume the high-gravity solids that are within the water-based drilling fluid includes: calculating a thermal conductivity for the water-based drilling fluid as a function of the thermal conductivity of each of the brine, the low-gravity solids, and the high-gravity solids.

Example 3 is the system of any of example(s) 1-2, wherein the inlet receives the water-based drilling fluid before the water-based drilling fluid is pumped into the wellbore.

Example 4 is the system of any of example(s) 1-3, wherein the inlet receives the water-based drilling fluid as the water-based drilling fluid exits the wellbore.

Example 5 is the system of any of example(s) 1-4, wherein determining a volume of brine, a volume of low-gravity solids, and a volume high-gravity solids within the water-based drilling fluid includes: measuring a density of the water-based drilling fluid; and determining updated values for the volume of the brine in real-time, the volume of the low-gravity solids, and the volume of the high-gravity solids with every density measurement.

Example 6 is the system of any of example(s) 1-5, wherein in the property is a hydrostatic pressure exerted by the water-based drilling fluid within the wellbore, and determining the fluid composition of the water-based drilling fluid includes: determining that the hydrostatic pressure is lower than the target property value; and increasing the volume of the high-gravity solids relative to the brine in the water-based drilling fluid to increase the hydrostatic pressure that is exerted by the water-based drilling fluid such that the hydrostatic pressure that is exerted is approximately equal to the target property value.

Example 7 is the system of any of example(s) 1-6, wherein in the property is a hydrostatic pressure exerted by the water-based drilling fluid within the wellbore, and wherein determining the fluid composition of the water-based drilling fluid includes: determining that the hydrostatic pressure exceeds the target property value; and increasing the volume of the brine relative to the high-gravity solids in the water-based drilling fluid to decrease the hydrostatic pressure that is exerted by the water-based drilling fluid such that the hydrostatic pressure that is exerted is approximately equal to the target property value.

Example 8 is a method comprising: receiving a water-based drilling fluid configured to be pumped into a wellbore during drilling operations, the water-based drilling fluid including brine, a low-gravity solids, and a high-gravity solids; determining a volume of the brine, a volume of the low-gravity solids, and a volume the high-gravity solids that are within the water-based drilling fluid; calculating, using the volume of the low-gravity solids and the volume of the high-gravity solids, an average specific gravity of the water-based drilling fluid; determining, using the volume of the brine, a percentage of water that is within the water-based drilling fluid; receiving a target property value that corresponds to an optimal value of a property of the water-based drilling fluid; calculating, using the average specific gravity and the percentage of water, a value of the property of the water-based drilling fluid; and determining a fluid composition of the water-based drilling fluid such that the value of the property of the water-based drilling fluid is approximately equal to the target property value.

Example 9 is the method of example(s) 8, wherein determining the volume of the brine, the volume of the low-gravity solids, and the volume the high-gravity solids that are within the water-based drilling fluid includes: calculating a thermal conductivity for the water-based drilling fluid as a function of the thermal conductivity of each of the brine, the low-gravity solids, and the high-gravity solids.

Example 10 is the method of any of example(s) 8-9, wherein the water-based drilling fluid is received prior to the water-based drilling fluid being pumped into the wellbore.

Example 11 is the method of any of example(s) 8-10, wherein the water-based drilling fluid is received as it exits the wellbore.

Example 12 is the method of any of example(s) 8-11, wherein determining the volume of the brine, the volume of the low-gravity solids, and the volume the high-gravity solids within the water-based drilling fluid includes: measuring a density of each of the brine, the low-gravity solids, and the high-gravity solids every sixty seconds; and determining updated values for the volume of the brine in real-time, the volume of the low-gravity solids, and the volume the high-gravity solids with every density measurement.

Example 13 is the method of any of example(s) 8-12, wherein in the property is a hydrostatic pressure exerted by the water-based drilling fluid within the wellbore, and wherein determining the fluid composition of the water-based drilling fluid includes: determining that the hydrostatic pressure is lower than the target property value; and increasing the volume of the high-gravity solids relative to the brine in the water-based drilling fluid to increase the hydrostatic pressure that is exerted by the water-based drilling fluid such that the hydrostatic pressure that is exerted is approximately equal to the target property value.

Example 14 is the method of any of example(s) 8-13, wherein in the property is a hydrostatic pressure exerted by the water-based drilling fluid within the wellbore, and wherein determining the fluid composition of the water-based drilling fluid includes: determining that the hydrostatic pressure exceeds the target property value; and increasing the volume of the brine relative to the high-gravity solids in the water-based drilling fluid to decrease the hydrostatic pressure that is exerted by the water-based drilling fluid such that the hydrostatic pressure that is exerted is approximately equal to the target property value.

Example 15 is a non-transitory computer-readable medium including instructions that are executable by one or more processors to cause the one or more processors to perform operations including: receiving a water-based drilling fluid configured to be pumped into a wellbore during drilling operations, the water-based drilling fluid including brine, a low-gravity solids, and a high-gravity solids; determining a volume of the brine, a volume of the low-gravity solids, and a volume the high-gravity solids that are within the water-based drilling fluid; calculating, using the volume of the low-gravity solids and the volume of the high-gravity solids, an average specific gravity of the water-based drilling fluid; determining, using the volume of the brine, a percentage of water that is within the water-based drilling fluid; receiving a target property value that corresponds to an optimal value of a property of the water-based drilling fluid; calculating, using the average specific gravity and the percentage of water, a value of the property of the water-based drilling fluid; and determining a fluid composition of the water-based drilling fluid such that the value of the property of the water-based drilling fluid is approximately equal to the target property value.

Example 16 is the non-transitory computer-readable medium of example(s) 15, wherein determining the volume of the brine, the volume of the low-gravity solids, and the volume the high-gravity solids that are within the water-based drilling fluid includes: calculating a thermal conductivity for the water-based drilling fluid as a function of the thermal conductivity of each of the brine, the low-gravity solids, and the high-gravity solids.

Example 17 is the non-transitory computer-readable medium of any of example(s) 15-16, wherein the water-based drilling fluid is received as it exits the wellbore.

Example 18 is the non-transitory computer-readable medium of any of example(s) 15-17, wherein determining the volume of the brine, the volume of the low-gravity solids, and the volume of the high-gravity solids within the water-based drilling fluid includes: measuring a density of each of the brine, the low-gravity solids, and the high-gravity solids every sixty seconds; and determining updated values for the volume of the brine in real-time, the volume of the low-gravity solids, and the volume of the high-gravity solids with every density measurement.

Example 19 is the non-transitory computer-readable medium of any of example(s) 15-18, wherein in the property is a hydrostatic pressure exerted by the water-based drilling fluid within the wellbore, and wherein determining the fluid composition of the water-based drilling fluid includes: determining that the hydrostatic pressure is lower than the target property value; and increasing the volume of the high-gravity solids relative to the brine in the water-based drilling fluid to increase the hydrostatic pressure that is exerted by the water-based drilling fluid such that the hydrostatic pressure that is exerted is approximately equal to the target property value Example 20 is the non-transitory computer-readable medium of any of example(s) 15-19, wherein in the property is a hydrostatic pressure exerted by the water-based drilling fluid within the wellbore, and wherein determining the fluid composition of the water-based drilling fluid includes: determining that the hydrostatic pressure exceeds the target property value; and increasing the volume of the brine relative to the high-gravity solids in the water-based drilling fluid to decrease the hydrostatic pressure that is exerted by the water-based drilling fluid such that the hydrostatic pressure that is exerted is approximately equal to the target property value.

Specific details are given in the above description to provide a thorough understanding of the embodiments. However, it is understood that the embodiments may be practiced without these specific details. For example, well-known processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, or a combination thereof.

Also, it is noted that the embodiments may be described as a process which is depicted as a flowchart, a flow diagram, a swim diagram, a data flow diagram, a structure diagram, or a block diagram. Although a depiction may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages, or any combination thereof. When implemented in software, firmware, middleware, scripting language, microcode, or combinations thereof, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, program statements, or combinations thereof. A code segment may be coupled to another code segment or a hardware circuit by passing or receiving information, data, arguments, parameters, memory contents, or combinations thereof. Information, arguments, parameters, data, etc. may be passed, forwarded, or transmitted via any suitable means including memory sharing, message passing, token passing, network transmission, etc.

For a implementations in firmware, software, or combinations thereof, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, non-volatile, or other storage medium and is not to be limited to any particular type of memory or number of memories, or type of media upon which memory is stored.

Moreover, as disclosed herein, the term "storage medium" may represent one or more memories for storing data, including read only memory (ROM), random access memory (RAM), magnetic RAM, core memory, magnetic disk storage mediums, optical storage mediums, flash memory devices, other machine readable mediums for storing information, or combinations thereof. The term "non-transitory computer-readable medium" includes, but is not limited to portable or fixed storage devices, optical storage devices, or various other storage mediums capable of storing that can persistently contain or carry instruction(s), data, or combinations thereof.

While the principles of the disclosure have been described above in connection with specific apparatuses and methods, it is to be clearly understood that this description is made only by way of example and not as limitation on the scope of the disclosure.

What is claimed is:

1. A system comprising a housing defining a fluid reservoir, the housing including an inlet to receive a water-based drilling fluid that is configured to be pumped into a wellbore, the water-based drilling fluid comprising of brine, a low-gravity solids, and a high-gravity solids;

a fluid analyzer comprising one or more processors and a non-transitory computer-readable medium storing instructions that when executed by the one or more processors cause the fluid analyzer to perform operations including:

receiving a target property value that corresponds to an optimal value of a property of the water-based drilling fluid;

determining a volume of the brine, a volume of the low-gravity solids, and a volume the high-gravity solids that are within the water-based drilling fluid;

calculating, using the volume of the low-gravity solids and the volume of the high-gravity solids, an average specific gravity of the water-based drilling fluid;

determining, using the volume of the brine, a percentage of water that is within the water-based drilling fluid;

calculating, using the average specific gravity and the percentage of water, a value of the property of the water-based drilling fluid; and controlling a drilling system to reformulate a fluid composition of the water-based drilling fluid using the value of the property of the water-based drilling fluid.

2. The system of claim 1, wherein determining the volume of the brine, the volume of the low-gravity solids, and the volume the high-gravity solids that are within the water-based drilling fluid includes:

calculating a thermal conductivity for the water-based drilling fluid as a function of the thermal conductivity of each of the brine, the low-gravity solids, and the high-gravity solids.

3. The system of claim 1, wherein the inlet receives the water-based drilling fluid before the water-based drilling fluid is pumped into the wellbore.

4. The system of claim 1, wherein the inlet receives the water-based drilling fluid as the water-based drilling fluid exits the wellbore.

5. The system of claim 1, wherein determining a volume of brine, a volume of low-gravity solids, and a volume high-gravity solids within the water-based drilling fluid includes:

measuring a density of the water-based drilling fluid; and determining updated values for the volume of the brine in real-time, the volume of the low-gravity solids, and the volume of the high-gravity solids with every density measurement.

6. The system of claim 1, wherein in the property is a hydrostatic pressure exerted by the water-based drilling fluid within the wellbore, and wherein controlling the drilling system to reformulate the fluid composition of the water-based drilling fluid using the value of the property of the water-based drilling fluid includes:

determining that the hydrostatic pressure is lower than the target property value; and increasing the volume of the high-gravity solids relative to the brine in the water-based drilling fluid to increase the hydrostatic pressure that is exerted by the water-based drilling fluid such that the hydrostatic pressure that is exerted is approximately equal to the target property value.

7. The system of claim 1, wherein in the property is a hydrostatic pressure exerted by the water-based drilling fluid within the wellbore, and wherein controlling the drilling system to reformulate the fluid composition of the water-based drilling fluid using the value of the property of the water-based drilling fluid includes:

determining that the hydrostatic pressure exceeds the target property value; and increasing the volume of the brine relative to the high-gravity solids in the water-based drilling fluid to decrease the hydrostatic pressure that is exerted by the water-based drilling fluid such that the hydrostatic pressure that is exerted is approximately equal to the target property value.

8. A method comprising:

receiving a water-based drilling fluid configured to be pumped into a wellbore during drilling operations, the water-based drilling fluid including brine, a low-gravity solids, and a high-gravity solids;

determining a volume of the brine, a volume of the low-gravity solids, and a volume the high-gravity solids that are within the water-based drilling fluid;

calculating, using the volume of the low-gravity solids and the volume of the high-gravity solids, an average specific gravity of the water-based drilling fluid;

determining, using the volume of the brine, a percentage of water that is within the water-based drilling fluid;

receiving a target property value that corresponds to an optimal value of a property of the water-based drilling fluid;

calculating, using the average specific gravity and the percentage of water, a value of the property of the water-based drilling fluid; and controlling a drilling system to reformulate a fluid composition of the water-based drilling fluid using the value of the property of the water-based drilling fluid.

9. The method of claim 8, wherein determining the volume of the brine, the volume of the low-gravity solids, and the volume the high-gravity solids that are within the water-based drilling fluid includes:

calculating a thermal conductivity for the water-based drilling fluid as a function of the thermal conductivity of each of the brine, the low-gravity solids, and the high-gravity solids.

10. The method of claim 8, wherein the water-based drilling fluid is received prior to the water-based drilling fluid being pumped into the wellbore.

11. The method of claim 8, wherein the water-based drilling fluid is received as it exits the wellbore.

12. The method of claim 8, wherein determining the volume of the brine, the volume of the low-gravity solids, and the volume the high-gravity solids within the water-based drilling fluid includes:

measuring a density of each of the brine, the low-gravity solids, and the high-gravity solids every sixty seconds; and determining updated values for the volume of the brine in real-time, the volume of the low-gravity solids, and the volume the high-gravity solids with every density measurement.

13. The method of claim 8, wherein in the property is a hydrostatic pressure exerted by the water-based drilling fluid within the wellbore, and wherein controlling the drilling system to reformulate the fluid composition of the water-based drilling fluid using value of the property of the water-based drilling fluid includes:

determining that the hydrostatic pressure is lower than the target property value; and increasing the volume of the high-gravity solids relative to the brine in the water-based drilling fluid to increase the hydrostatic pressure that is exerted by the water-based drilling fluid such that the hydrostatic pressure that is exerted is approximately equal to the target property value.

14. The method of claim 8, wherein in the property is a hydrostatic pressure exerted by the water-based drilling fluid within the wellbore, and wherein controlling the drilling system to reformulate the fluid composition of the water-based drilling fluid using the value of the property of the water-based drilling fluid:

determining that the hydrostatic pressure exceeds the target property value; and increasing the volume of the brine relative to the high-gravity solids in the water-based drilling fluid to decrease the hydrostatic pressure that is exerted by the water-based drilling fluid such that the hydrostatic pressure that is exerted is approximately equal to the target property value.

15. A non-transitory computer-readable medium including instructions that are executable by one or more processors to cause the one or more processors to perform operations including:

receiving a water-based drilling fluid configured to be pumped into a wellbore during drilling operations, the water-based drilling fluid including brine, a low-gravity solids, and a high-gravity solids;

determining a volume of the brine, a volume of the low-gravity solids, and a volume the high-gravity solids that are within the water-based drilling fluid;

calculating, using the volume of the low-gravity solids and the volume of the high-gravity solids, an average specific gravity of the water-based drilling fluid;

determining, using the volume of the brine, a percentage of water that is within the water-based drilling fluid;

receiving a target property value that corresponds to an optimal value of a property of the water-based drilling fluid;

calculating, using the average specific gravity and the percentage of water, a value of the property of the water-based drilling fluid; and controlling a drilling system to reformulate a fluid composition of the water-based drilling fluid using the value of the property of the water-based drilling fluid.

16. The non-transitory computer-readable medium of claim 15, wherein determining the volume of the brine, the volume of the low-gravity solids, and the volume the high-gravity solids that are within the water-based drilling fluid includes:

calculating a thermal conductivity for the water-based drilling fluid as a function of the thermal conductivity of each of the brine, the low-gravity solids, and the high-gravity solids.

17. The non-transitory computer-readable medium of claim 15, wherein the water-based drilling fluid is received as it exits the wellbore.

18. The non-transitory computer-readable medium of claim 15, wherein determining the volume of the brine, the volume of the low-gravity solids, and the volume of the high-gravity solids within the water-based drilling fluid includes:

measuring a density of each of the brine, the low-gravity solids, and the high-gravity solids every sixty seconds; and determining updated values for the volume of the brine in real-time, the volume of the low-gravity solids, and the volume of the high-gravity solids with every density measurement.

19. The non-transitory computer-readable medium of claim 15, wherein in the property is a hydrostatic pressure exerted by the water-based drilling fluid within the wellbore, and wherein controlling the drilling system to reformulate the fluid composition of the water-based drilling fluid using the value of the property of the water-based drilling fluid includes:

determining that the hydrostatic pressure is lower than the target property value; and increasing the volume of the high-gravity solids relative to the brine in the water-based drilling fluid to increase the hydrostatic pressure that is exerted by the water-based drilling fluid such that the hydrostatic pressure that is exerted is approximately equal to the target property value.

20. The non-transitory computer-readable medium of claim 15, wherein in the property is a hydrostatic pressure exerted by the water-based drilling fluid within the wellbore, and controlling the drilling system to reformulate the fluid composition of the water-based drilling fluid using the value of the property of the water-based drilling fluid includes:

determining that the hydrostatic pressure exceeds the target property value; and increasing the volume of the brine relative to the high-gravity solids in the water-based drilling fluid to decrease the hydrostatic pressure that is exerted by the water-based drilling fluid such that the hydrostatic pressure that is exerted is approximately equal to the target property value.

* * * * *